United States Patent [19]

Trotta

[11] 4,324,041

[45] Apr. 13, 1982

[54] RAZOR BLADE ASSEMBLY

[75] Inventor: Robert A. Trotta, Winthrop, Mass.

[73] Assignee: The Gillette Company, Boston, Mass.

[21] Appl. No.: 176,138

[22] Filed: Aug. 7, 1980

[51] Int. Cl.[3] ..... B26B 21/22

[52] U.S. Cl. ..... 30/47; 30/50; 30/57; 30/83

[58] Field of Search ..... 30/47, 50, 57, 346.58, 30/346.59, 304, 305, 83.77; 83/582, 583

[56] References Cited

U.S. PATENT DOCUMENTS

| | | | |
|---|---|---|---|
| 3,593,416 | 7/1971 | Edson | 30/57 X |
| 4,016,648 | 4/1977 | Chen et al. | 30/47 |
| 4,063,354 | 12/1977 | Oldroyd et al. | 30/47 |
| 4,069,580 | 1/1978 | Cartwright et al. | 30/47 |
| 4,184,246 | 1/1980 | Trotta | 30/47 |
| 4,270,268 | 6/1981 | Jacobson | 30/50 X |

*Primary Examiner*—Frank T. Yost
*Attorney, Agent, or Firm*—Scott R. Foster

[57] ABSTRACT

A razor blade assembly comprising a cap portion and a base portion, first arm means extending from the base portion and joining a guard portion extending generally parallel to the base portion, second arm means extending from the base portion toward the guard portion, and blade means disposed on the second arm means, the arm means being leaf spring-like structures permitting movement of the guard portion and the blade means relative to the base portion and cap portion during a shaving operation.

24 Claims, 8 Drawing Figures

RAZOR BLADE ASSEMBLY

BACKGROUND OF THE INVENTION

1. Field of the Invention

The invention relates to wet shaving implements, and is directed more particularly to a blade assembly in which blade means are permanently secured in a housing having cap and guard portions.

2. Description of the Prior Art

In U.S. Pat. No. 4,270,268, in the name of Chester A. Jacobson, there is shown and described a blade assembly in which guard and blade portions are mounted for independent movement during a shaving operation. A pair of leaf spring-like arms extend inwardly from either end of the assembly to form a resilient mounting for a guard portion. In like manner, another pair of arms support a first blade member and still another pair of arms support a second blade member. The arms are movable independently of each other, providing an independent dynamic movement facility for each of the guard and blade members responsive to forces encountered during a shaving operation.

While the above-mentioned blade assembly functions well and provides a close shave substantially free of skin nicks and cuts, it is of benefit to simplify its structure and thereby reduce the costs involved in production.

SUMMARY OF THE INVENTION

It is therefore, an object of the present invention to provide a blade assembly of the type disclosed in U.S. Pat. No. 4,270,268, but of different construction permitting of less expensive manufacture.

With the above and other objects in view, as will hereinafter appear, a feature of the present invention is the provision of a razor blade assembly comprising a cap portion and a base portion, first arm means extending from the base portion and joining a guard portion extending generally parallel to the base portion, second arm means extending from the base portion toward the guard portion, and blade means disposed on the second arm means, the arm means being leaf spring-like structures permitting movement of the guard portion and the blade means relative to the base portion and cap portion during a shaving operation.

The above and other features of the invention, including various novel details of construction and combinations of parts, will now be more particularly described with reference to the accompanying drawings and pointed out in the claims. It will be understood that the particular razor assembly embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention from which its novel features and advantages will be apparent.

In the drawings.

DESCRIPTION OF THE PREFERRED EMBODIMENT

Figure 1:
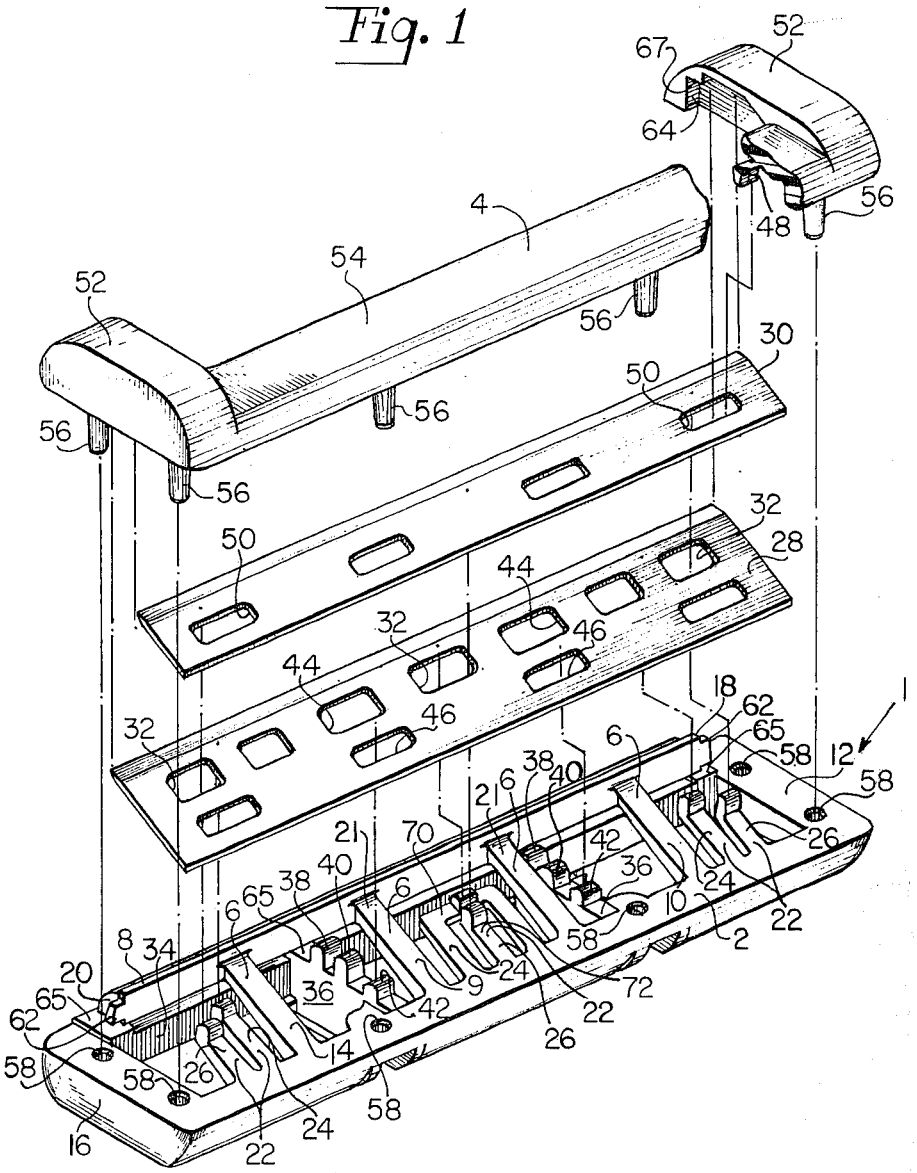
FIG. 1 is an exploded perspective view of one form of razor blade assembly illustrative of an embodiment of the invention.

Referring to the drawings, it will be seen that the illustrative razor blade assembly includes a platform member 1 having a base portion 2. The platform member 1 is joined to a cap portion 4. First arm means 6 extend from the base portion 2 and are joined to a guard portion 8 extending generally parallel to the base portion. Preferably, the first arm means 6 include a first set of arms 9, including a first arm 10 proximate a first end 12 of the platform member 1 and a second arm 14 proximate a second end 16 of the platform member, the first arm 10 joining the guard portion 8 proximate a first end 18 of the guard portion and a second arm 14 joining the guard portion proximate a second end 20 of the guard portion. The first set of arms 9 preferably includes additional arms 21 disposed between the first and second arms 10, 14.

The blade assembly further includes a second arm means 22 disposed inwardly of the ends of the platform member 1 and extending from the base portion 2 generally toward, and terminating short of, the guard portion.

In the embodiment shown, the second arm means 22 include second and third sets of arms 24, 26. A first blade means 28 is disposed on the second set of arms 24 and a second blade means 30 is disposed on the third set of arms 26.

Preferably, the base portion 2, arm means 6, 22, and guard portion 8 are of molded material and are molded as a single, unitary and integral member. The arm means function as leaf springs, permitting movement of the guard portion and the blade means relative to the base portion and the cap portion, and to each other, during a shaving operation.

As seen in the drawings, the first blade means 28 is provided with apertures 32 through which extend the third set of arms 26, the ends of which support the second blade means 30.

The platform member 1 includes a frame portion 34 extending parallel to the base portion 2 and interconnecting the platform end portions 12, 16. Extending between the frame portion 34 and the base portion 2 are bridge members 36, each provided with first, second and third protrusions, 38, 40, 42. As will be further described below, the protrusion 38 operates as a stop means for the first blade means 28 and the protrusion 40 operates as a stop means for the second blade means 30. The second protrusions 40 extend through openings 44 in the first blade means 28, enabling the second protrusions to be engaged by the second blade means 30. The third protrusions 42 extend through apertures 46 in the first blade means 28 to underlie the second blade means 30.

The cap portion 4 includes downwardly-extending protrusions 48 which pass through holes 50 in the second blade means 30 and overlie the upper surface of the first blade means 28.

Preferably, the bridge members are molded integrally with the remainder of the platform member 1 and the protrusions 48 are molded portions of the cap 4.

Figure 8:
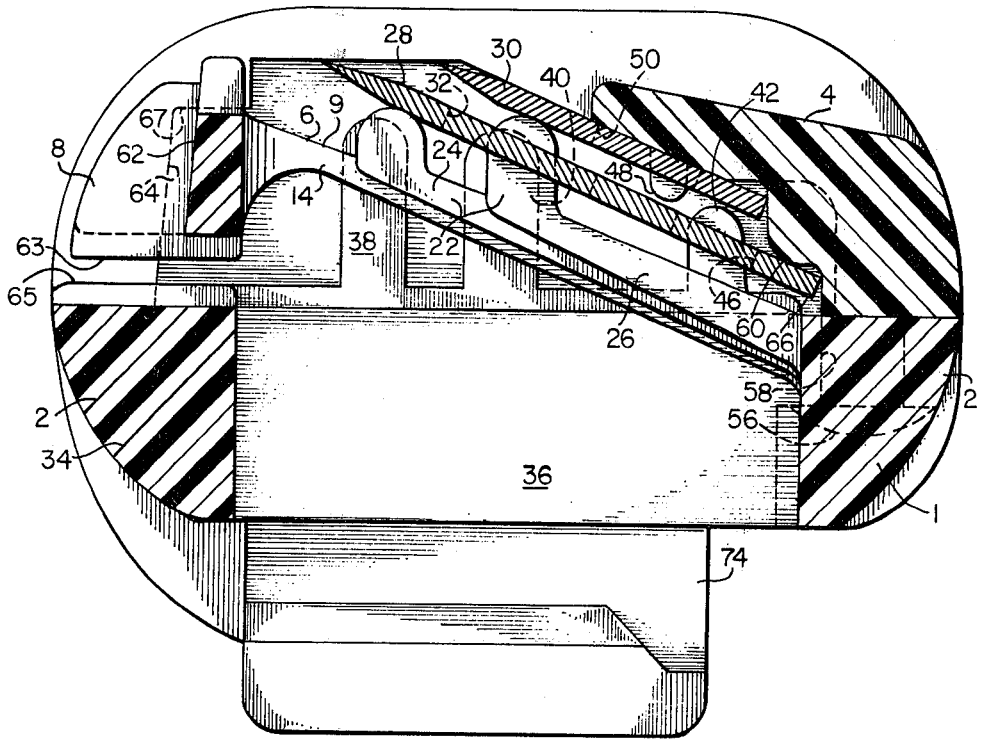
FIG. 8 is a sectional view taken along line VIII—VIII of FIG. 7.

In assembly, the platform and cap portions are molded with means for interconnection. In the illustrated embodiment, the cap 4 is provided with end portions 52 interconnected by a back portion 54. Rivet members 56 depend from the end portions 52 and the back portion 54. The platform portion 1 is provided with holes 58 on its end portions 12, 16 and base portion 2 adapted to receive the rivet members 56. The second blade means 30 is placed on the underside of the cap portion 4, inverted for the assembly operation, with the protrusions 48 extending through the holes 50. The first blade means 28 is then placed over the second blade means 30. The platform portion 1 is fitted onto the cap portion 4 and over the first blade means 28, the apertures 32, 46 and openings 44 permitting the third set of arms 26 and the protrusions 40, 42 to extend through the first blade means. The rivet members 56 are secured in the platform holes 58 by heading over, bringing the second blade means 30 to rest on the third set of arms 26. The cap portion 4 is formed with a shoulder 60 which bears against the first blade means 28, as seen in FIG. 8.

The guard portion 8 has on either end thereof outwardly extending detents 62 which, in assembly, are received by recesses 64 in the cap end portions 52. The guard portion 8 is further provided with stop portions 63 on the underside of the guard portion, the stop portions 63 being in alignment with stop portions 65 upstanding from the frame member 34. Two of the stop portions 65 may comprise portions of the bridge members 36.

Thus, the first blade means 28 rests upon the second set of arms 24 proximate the cutting edge of the first blade means, the rearward edge thereof being loosely held in a pocket 66 (FIG. 8) formed by the cap and platform portions, and particularly the shoulder portion 60 of the cap. The pocket 66 provides sufficient freedom to permit the first blade means to pivot about its rearward edge. The upstanding protrusions 42 prevent the first blade from sliding forwardly or backwardly. In similar manner, the second blade means 30 rests upon the third set of arms 26, its rearward edge being disposed in a pocket 68 formed by the cap portion and the protrusions 42. The pocket 68 provides sufficient freedom to permit the second blade to pivot about it rearward edge. The second blade means is prevented from sliding forwardly or backwardly by the protrusions 48.

In use, the guard portion 8 is freely movable during a shaving operation by virture of the spring leaf-like qualities of the arms 10, 14. The stop portions 65 of the frame portion 34 and upper surfaces 67 of the recesses 64 limit the movement of the guard portion, the guard stop portions 63 abutting the frame stop portions 65 at the lower extent of the permissible movement of the guard portion, and the detents 62 abutting the upper surfaces 67 of the recesses 64 at the upper extent of the permissible movement of the guard portion. In like manner, the blade means 28, 30 are each freely and independently movable during a shaving operation by virture of the spring leaf-like qualities of the arms 24, 26. The cutting edge of the first blade means 28 can be depressed, or moved downwardly and pivotally about its rear edge, until the first blade means strikes the first protrusion 38. In like manner, the second blade means 30 can be depressed, or moved downwardly and pivotally about its rear edge until the second blade means strikes the second protrusion 40. During a shaving operation, the guard and blade members may move dynamically in response to forces and pressures acting on the blade assembly during shaving, the guard and blade means being movable in a substantially arcuate path about a rear portion of the blade assembly.

Figure 2:
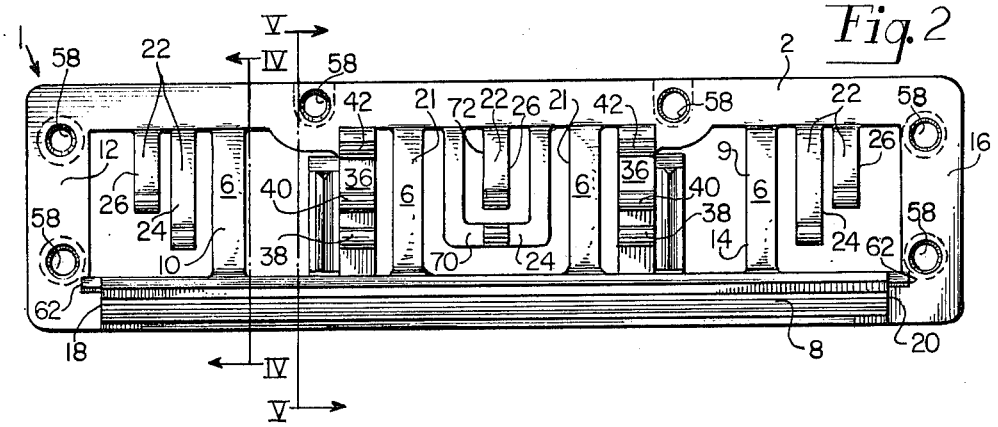
FIG. 2 is a top plan view of a platform portion of the blade assembly.
Figure 3:
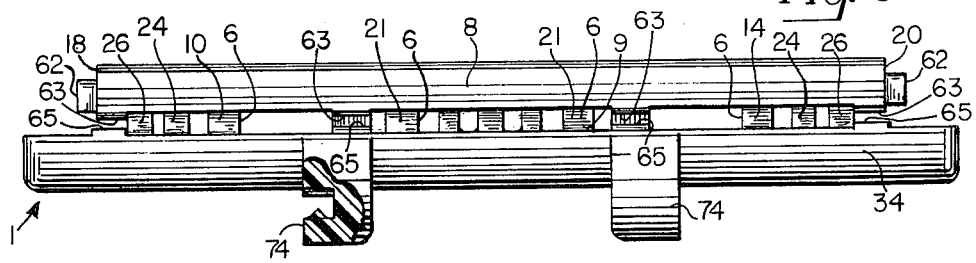
FIG. 3 is a front elevational view of the platform portion.
Figure 4:
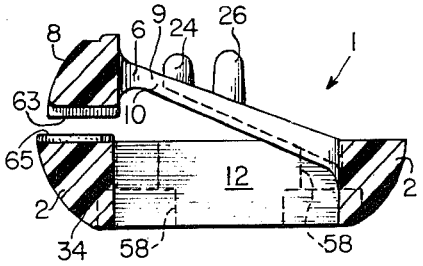
FIG. 4 is a sectional view taken along line IV—IV of FIG. 2.
Figure 5:
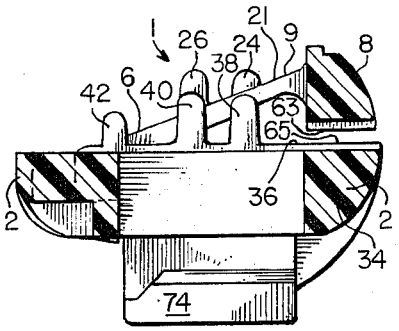
FIG. 5 is a sectional view taken along line V—V of FIG. 2.
Figure 6:
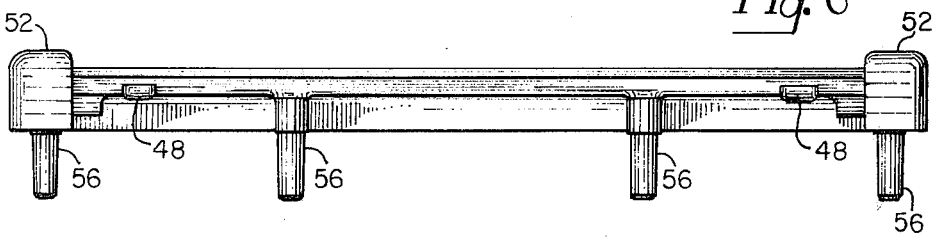
FIG. 6 is a front elevational view of a cap portion of the blade assembly.
Figure 7:
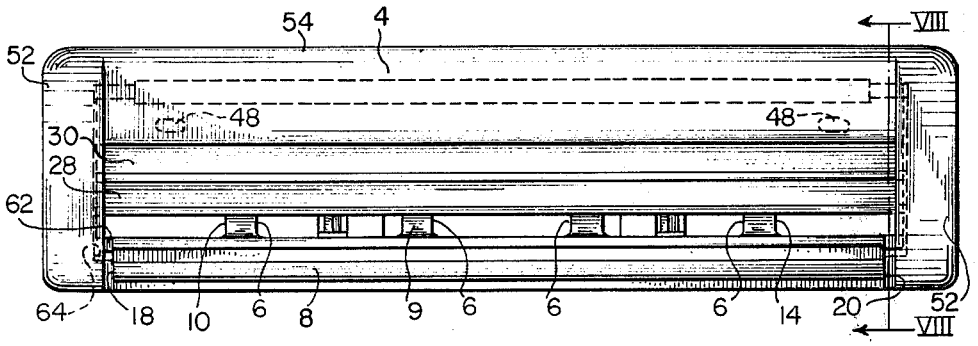
FIG. 7 is a top plan view of the blade assembly.

Referring particularly to FIGS. 1 and 2, it will be seen that in the illustrated embodiment, the central arm 70 of the second set of arms 24 is substantially U-shaped, permitting a central location of such arm, as well as a central location for the central arm 72 of the third set of arms 26.

The blade assembly is provided with attachment means 74 by which the assembly may be releasably connected to a razor handle. The structure and operation of such attachment means is fully shown and described in U.S. patent application Ser. No. 101,261. Alternatively, the blade assembly may be permanently fixed to a handle (not shown) the entire blade assembly and handle constituting a razor which is disposable as a unit after dulling of the blade cutting edges.

It is to be understood that the present invention is by no means limited to the particular construction herein disclosed and/or shown in the drawings, but also comprises any modifications or equivalents within the scope of the disclosure. For example, suitable attachment means of a different type are shown and described in U.S. Pat. Nos. 3,703,764 and 3,832,774. The attachment means therein described utilize parallel grooves and rails, facilitating a slide attachment between a razor handle and a blade assembly.

Having thus described my invention, what I claim as new and desire to secure by Letters Patent in the United States is:

1. A razor blade assembly comprising a cap portion and a base portion, first arm means extending from said base portion and joining a guard portion extending generally parallel to said base portion, second arm means extending from said base portion toward said guard portion, and blade means disposed on said second arm means, said first and second arm means being leaf spring means permitting movement of said guard portion and said blade means relative to said base portion and said cap portion during a shaving operation.

2. The invention in accordance with claim 1 in which said first arm means includes a first set of arms interconnecting said base portion and said guard portion, said second arm means comprises second and third set of arms, and said blade means comprises first and second blades, said first blade being disposed on said second set of arms and said second blade being disposed on said third set of arms.

3. The invention in accordance with claims 1 or 2 in which said base portion, said arm means, and said guard portion are of molded material and are molded integrally with each other.

4. The invention in accordance with claim 2 in which said third set of arms extends through apertures in said first blade.

5. A razor blade assembly comprising a platform including a base portion, a cap portion fixed to said platform, a guard portion extending parallel to said base portion and connected to said base portion, blade support means extending from said base portion, and blade means disposed on said blade support means, said guard means and said blade means being independently arcuately movable about said base portion and cap portion during a shaving operation.

6. The invention in accordance with claim 5 in which said blade support means include first and second blade support means, and said blade means include first blade means fixed to said first blade support means and second blade means fixed to said second blade support means, each of said blade means being arcuately movable about said base portion and cap portion independently of each other and of said guard portion during a shaving operation.

7. A razor blade assembly comprising a platform member having a base portion, first arm means extending from said base portion and connected to a guard portion, said first arm means being adapted to flex about its juncture with said base portion to facilitate arcuate movement of said guard portion about said base portion, second arm means extending from said base portion toward said guard portion, blade means disposed on said second arm means, said second arm means being adapted to flex about its juncture with said base portion to facilitate arcuate movement of a cutting edge portion of said blade means, and stop means extending from said platform and engageable by said blade means to limit said movement of said blade means.

8. The invention in accordance with claim 7 in which said blade assembly further comprises a cap member connected to said platform member with said blade means disposed therebetween, said platform and said cap members cooperatively forming pocket means having movably disposed therein a lengthwise edge portion of said blade means.

9. The invention in accordance with claim 8 in which said first arm means comprises a first set of arms, said second arm means include a second set of arms and a third set of arms, and said blade means comprises a first blade means disposed on said second set of arms and a second blade means disposed on said third set of arms.

10. The invention in accordance with claim 9 in which said first blade means is provided with apertures through which extend said third set of arms.

11. The invention in accordance with claim 10 in which said stop means extend from said base portion and are engageable with said blade means to limit said arcuate movement of said blade means.

12. The invention in accordance with claim 11 in which said stop means include first stop means adapted to be engaged by said first blade means, and second stop means adapted to be engaged by said second blade means.

13. The invention in accordance with claim 12 in which said first blade means is provided with openings through which extend said second stop means.

14. The invention in accordance with claim 13 in which said platform further includes end portions extending from said base portion and interconnected by a frame portion disposed parallel to said base portion.

15. The invention in accordance with claim 14 including bridge means extending between said base portion and said frame portion, said first and second stop means being disposed on said bridge means.

16. The invention in accordance with claim 15 in which said first and second stop means comprise first and second protrusions, respectively, upstanding from said bridge means.

17. The invention in accordance with claim 16 in which a third protrusion upstands from each of said bridge means, and said first blade means is provided with apertures through which extend said third protrusions.

18. The invention in accordance with claim 17 in which said pocket means comprise first and second pockets in which are retained, respectively, said lengthwise edges of said first and second blade means.

19. The invention in accordance with claim 18 in which said second pocket is formed in part by said bridge means third protrusion.

20. The invention in accordance with claim 19 including protrusions extending from said cap portion, said second blade means having holes therein in which are disposed said protrusions.

21. The invention in accordance with claim 8 including stop means on said cap and platform members for limiting movement of said guard portion.

22. The invention in accordance with claim 21 in which said cap member is provided with recess means, and said guard portion is provided at either end thereof with an extension received by and movable in said recess means, a wall portion of said recess means limiting said movement of said guard portion.

23. The invention in accordance with claim 9 including attachment means disposed on said platform for attachment to a razor handle.

24. A razor comprising the blade assembly of claim 9 fixed to a handle member.

* * * * *